United States Patent [19]

DiNitto et al.

[11] Patent Number: 4,625,203

[45] Date of Patent: Nov. 25, 1986

[54] ARRANGEMENT FOR PROVIDING DATA SIGNALS FOR A DATA DISPLAY SYSTEM

[75] Inventors: Robert S. DiNitto, Chelsea; Thomas C. Porcher, Stow; John W. Eng, Southborough; Charles S. Namias, Burlington; David B. Hughes, Hudson, all of Mass.

[73] Assignee: Digital Equipment Corporation, Maynard, Mass.

[21] Appl. No.: 543,107

[22] Filed: Oct. 18, 1983

[51] Int. Cl.[4] ..... G09G 1/14

[52] U.S. Cl. ..... 340/750

[58] Field of Search ..... 340/723, 724, 726, 727, 340/750, 798

[56] References Cited

U.S. PATENT DOCUMENTS

| | | | |
|---|---|---|---|
| 4,240,075 | 12/1980 | Bringol | 340/724 X |
| 4,399,435 | 8/1983 | Urabe | 340/750 |
| 4,486,746 | 12/1984 | Walker | 340/750 |
| 4,496,944 | 1/1985 | Collmeyer et al. | 340/750 X |

*Primary Examiner*—Gerald L. Brigance

*Assistant Examiner*—Vincent P. Kovalick

*Attorney, Agent, or Firm*—William E. Cleaver

[57] ABSTRACT

The present invention includes a microprocessor which acts to generate groups of its signals from its read only memory (ROM) thereby forming character representations of groups of coded signals, such as ASCII coded signals, coming from a main data processing device. The groups of bit signals are temporarily stored in a buffer which at a subsequent time transmits, in parallel, groups of said bit signals to a bit map memory through some logic circuitry. The group, or block, transfer of said bit signals in parallel, occurs during horizontal or vertical blank periods. The parallel transfer during the blank periods provides part of the basis for acceleration of the data to a display device as compared with the prior art. In addition, the microprocessor provides address information signals to a graphic display controller, which in turn provides starting addresses, for the locations of the bit signals. In addition a bit map memory device is employed to provide pixel information to a CRT display device to create the characters which are to be shown.

8 Claims, 5 Drawing Figures

ARRANGEMENT FOR PROVIDING DATA SIGNALS FOR A DATA DISPLAY SYSTEM

BACKGROUND

In order to show some image on a cathode ray tube (CRT) screen whether it be text or graphics, the CRT beam must be turned on (brightened in the case of the image being bright and the background dull) at the correct time to produce a dot, or a series of dots to make a bar, and the like. The foregoing necessitates that the display system have a data storage means which transmits data signals, representing the image to be displayed, in synchronism with clock signals from a clock signal generator. In the prior art, the clock generator is usually located in the CRT circuitry. In synchronism with the clock signals, the CRT beam is turned on (or not turned on) as the beam gets to the correct data location. It should be understood that in the case of the intelligence being in a dark mode, against a bright background, then the beam would be turned off. All of the foregoing is well understood in the prior art.

Further in the major part of the prior art, if a system is going to display both graphics and text, two different memory and control systems have been employed. It has been only when the information is finally transmitted to the CRT device that the graphics and text signals have been meshed, or multiplexed.

The introduction of the bit map memory, to the display art, has made the task somewhat easier because in a bit map memory, there is a memory for each pixel location on the CRT screen. Hence, whatever image is to be seen (either text, or graphics, or a combination of both) can be written into the bit map memory and from that one memory (as it is scanned) both graphics and text data signals can be transmitted to the CRT screen to be shown.

The major problem that occurs in the prior art is that the bit map memory was not used for text but the text was encoded from a character generator and continually transmitted to the CRT. While the prior art system was fast, it required two separate memory systems. The present system permits both text and graphics to use the same memory while operating with the speed of the separate memories of the prior art. The present invention employs a five-fold improvement in transmitting data signals to the data display device as will explained below.

SUMMARY

The present system employs a microprocessor as a dedicated slave device to a main data processing system. The microprocessor responds to groups of coded signals, from the main data processing system. In response to each group of coded signals, the present system provides a group of bit signals from a ROM means which bit signals graphically define the text character assigned to the coded set of signals being received. In other words, if eight bits of ASCII coded signals are transmitted from the main data processing device, that group of signals causes, in a preferred embodiment, the generation of a raster of 8 by 10 bits from the ROM in the microprocessor. In the microprocessor, ten bytes of data are stored in ROM memory means for each possible text character to be shown. The group of bit signals are block transferred from the ROM of the microprocessor to a buffer. Thereafter the bit signal group, which has been properly arranged, is transferred in parallel during sync signal blank periods. To effect said block transfer, a graphic display controller device provides addresses to the bit map memory so that a block transfer is written into the bit map memory at a particular starting address.

The microprocessor is programmed to determine whether a block transfer requires one or two cycles and accordingly characters are transferred from the buffer in either one step or two steps. The bit signals in the buffer are located to match where, within a word location, in the bit map memory, they are to be ultimately located. The dedication of the microprocessor to providing encoded signals, the speed of the parallel transfer, the fact that the transfer is made during the horizontal and vertical blank periods, utilization of the graphic display controller to provide the addresses, and the prearrangement of the bits in the buffer enable the data transfer to be more rapidly accomplished than in the prior art.

The objects and features of the present invention will be better understood after studying the description below taken in conjunction with the drawings wherein.

Figure 1:
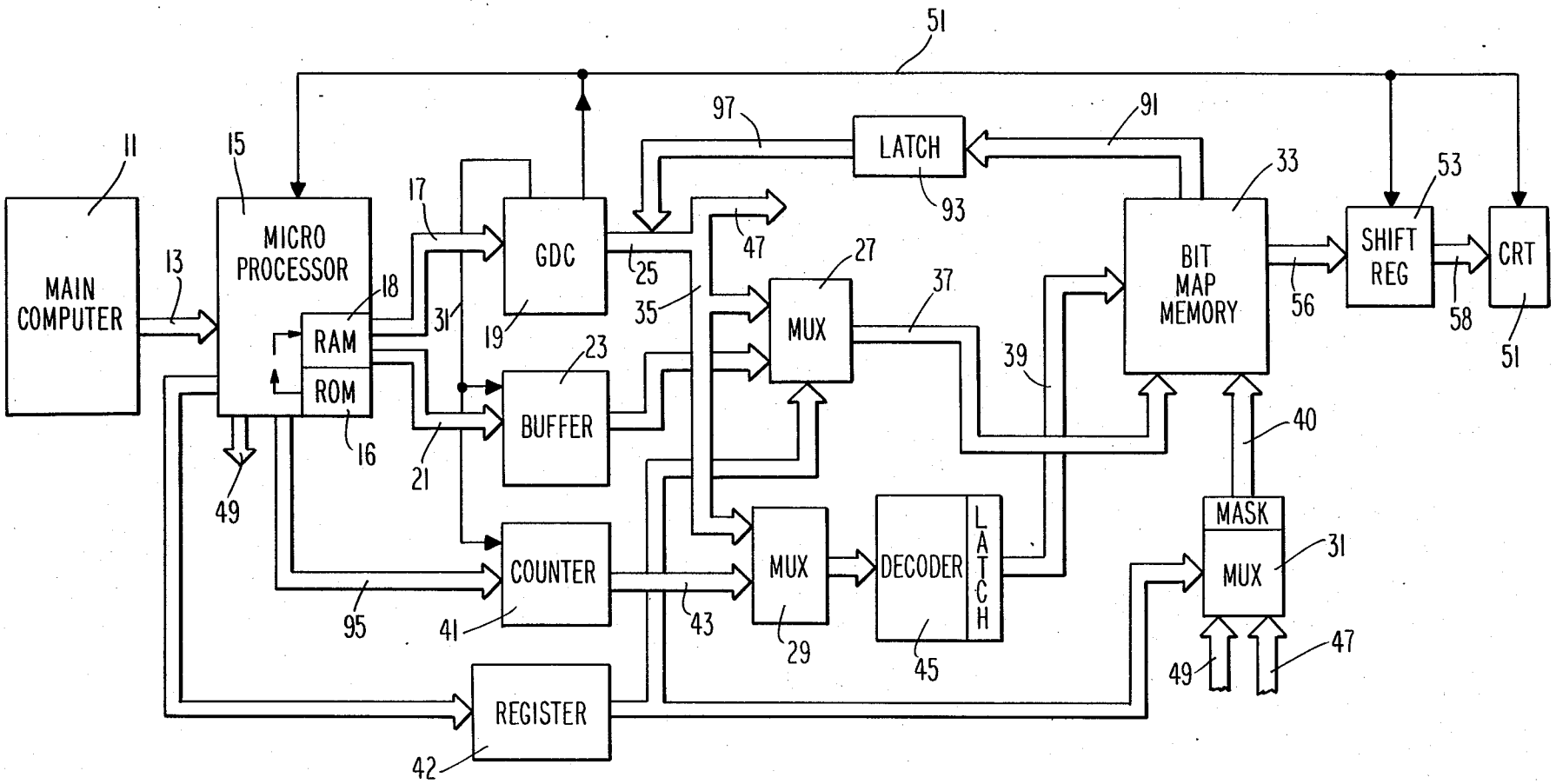
FIG. 1 is a block schematic diagram of the present system.

Consider FIG. 1. In FIG. 1 there is shown a main computer 11 which is connected by channel 13 to a microprocessor 15. It should be understood that the main computer 11 is the heart of a computing system and is connected to many terminals and peripherals which are not shown in FIG. 1. It should also be understood that the channels shown throughout FIG. 1 comprise a plurality of parallel wires and the signals transmitted over these channels include address signals, instruction signals, and data to be displayed signals. The microprocessor in a preferred embodiment is a an 8085 manufactured by Intel Corporation. It should be understood that the microprocessor 15 includes at least a central processing unit, ROM memory means, RAM memory means and the logic circuitry to generate instruction information signals.

As can be gleaned from FIG. 1 there is a buffer 23 connected by the channel 21 to the RAM 18 of the microprocessor 15. The present system operates with a 16 bit word that is broken up into two 8 bit bytes. In the ROM 16 there is stored a plurality of 8 by 10 bit groups each of which configures a character to be displayed. In other words, as will become clearer hereinafter the letter "D" would be graphically represented by bit signals stored in an appropriate location in the ROM. Also as will become clearer hereinafter, when the group of bit signals is transmitted from the ROM, it is transmitted through the central processing unit of the microprocessor back into the RAM 18 and in the course of that action the bit signals are revolved so that when they are transmitted from the RAM 18 along the channel 21 to the buffer 23, they end up being located in the proper locations for transmission to the bit map memory 33. The arranging of the bits etc. will be more clearly understood from the discussion of FIGS. 2 through 5.

The buffer 23 is formed to store 16 bits in a row and to store 10 rows. One character at a time is transferred from the RAM 18 to the buffer 23. The bit signals stored in the buffer 23, representing the character, are transferred in parallel, 16 bits at a time, through the MUX 27 along the channel 37 and into the bit map memory 33. As will become clearer in the discussion of FIGS. 2 through 5, when the bit signals are transmitted into the bit map memory, six of those bits are masked out on channel 40. The bit signals from the buffer 23 are located in the bit map memory in accordance with address signals present on channel 39.

As can also be gleaned from an examination of FIG. 1 there is a graphic display controller 19 connected to the microprocessor 15 through the channel 17. In a preferred embodiment the graphic display controller (hereinafter referred as the GDC) is a MICRO PD 7220 manufactured by NEC Corporation. The GDC 19 has memory means to store address and instruction information from the microprocessor and also includes two registers which can be incremented or decremented to accomplish the changing of an address. The GDC 19 also includes a write signal generator which provides clock signals as well as horizontal sync signals and vertical sync signals. The sync signals are transmitted on connection 57 to the CRT 51, to the shift register 53 and to the microprocessor 15. Write clock signals are transmitted to the buffer 23 and to destination counter 41 over connection 31. In addition the horizontal and vertical sync signals operate within the GDC 19 to accomplish certain operations therein. For every horizontal blank period there are seven write cycles generated and for every vertical blank period there are 594 write cycles generated. Other rates could be used.

The destination counter 41 is included in the layout in FIG. 1 because it is part of an overall system. However it is not employed with the invention described in this description. The operation of the destination counter 41 is described in my co-pending application entitled, "Split Screen Smooth Scrolling", Ser. No. 06/543,108 and which is assigned to the assignee of this application. The GDC 19 accepts address information and instruction information from the microprocessor 15 and holds that information to effect address signals on channel 39 so that characters being transferred from the buffer 23 are properly located in the bit map memory 33.

As can be seen in FIG. 1, the GDC 19 transmits its address information along the channel 25, along channel 35, through the MUX 29, through the decoder 45, onto the channel 39. The MUX 29 has a second input on channel 43, from the destination counter 41 but as was mentioned above, that circuitry plays no role in the operation of the present invention. Insofar as the present invention is concerned it can be considered that the address information from the GDC 19 always goes through the MUX 29, or to say it another way, it could be considered that the MUX 29 is not even present. The decoder 45 takes the address information and decodes it into the proper signals to operate with the bit map memory 33. In a preferred embodiment the decoder 45 is a 74LS253, manufactured by Texas Instrument Corporation. Those signals are held in the latch so that they are present when the bit signals on channel 37 arrive at the bit map memory. It should also be noted that channel 91 and latch 93 are also circuitry items which are used in connection with a split screen smooth scrolling circuit described in my copending application. To say it another way, the channel 91, the latch 93 and the channel 97 play no role in the operation of the present invention.

When the characters have been stored in the bit map memory 33, they are read therefrom in response to address signals on channel 39. The bit signals or pixel signals being transmitted from the bit map memory 33 are transmitted along the channel 56 to the shift register 53. The signals are advanced from the shift register 53 in response to horizontal sync signals on the connection 57. When the signals are advanced from the shift register 53 they pass along the channel 58 to the CRT 51. Since the signals on channel 58 are transmitted in synchronism with the horizontal sync signals they are in synchronism with the beam of the CRT which is what is required to provide the display.

In FIG. 1 there is shown a MUX 31 which has two inputs, namely channels 49 and 47. When bit signals are being transmitted from the buffer 23, through the MUX 27 and along the channel 37, certain of those signals must be masked so that only the proper positions in the bit map memory are energized. The microprocessor 15 through its CPU keeps an account of what signals, or what signals from the buffer device 23, require masking and hence a set of masked signals are transmitted on channel 49 to the MUX 31. The signals on the channel 49 in turn energize or do not energize certain write enable signals on channel 40 and the system in effect electronically masks certain of the signals on channel 37. The other input to the MUX 31 is channel 47 and that comes from GDC. The GDC 19 has the ability to transmit graphic display signals along channel 25 and channel 35 through the MUX 27 and along channel 37. While that capability is present in the system shown in FIG. 1, it does not become a part of the present invention. The present invention is directed to accelerating the signals representing text characters from the main computer 11 to the CRT 51. The five-fold feature of the present invention which acts together to accelerate the signals representing the characters includes the concept of using the microprocessor 15 as a dedicated slave. In accordance with this dedication, a group of 8 bit ASCII coded signals coming on channel 13 is immediately transformed into an 8 by 10 bit group which is transferred out of the ROM 16. That 8 by 10 bit group of bit signals is immediately transformed into a 16 by 10 bit group in the RAM 18 and is transferred to the buffer 23. In the course of that transformation the second feature comes into play because the bit signals are properly arranged during the foregoing transformation so that when they are located in the buffer 23, they are in the locations that they should be in, when they are transferred to the bit map memory 33. The third feature lies in the capability of the buffer 23 to transmit the bit signals in parallel and hence the proper locating of the bit signals in the bit map memory is speeded up because of the parallel transmission. The parallel transmissions are accomplished during blank periods and this feature too adds to the overall speeding up of the operation since the transmissions are taking place during time periods which otherwise might not be used. The fifth feature of the present invention is the use of the GDC 19 which provides the address information and monitors the address information so that the buffer sends its signals into the bit map memory at the proper addresses. As was mentioned earlier the GDC has two registers. In the "present" address register there is initially located the starting address to which the information in the buffer 23 will be sent and located. In response to each write signal from the write clock generator in the GDC 19 the starting address register is incremented. The region ending value register will initially be loaded with the value of ten in the preferred embodiment because the buffer 23 will have ten words stored therein and the operation is such that the buffer will be completely emptied before it is reloaded. Accordingly, in response to the write signals, the region ending value register will be decremented. When the region ending value register has a value of zero, the microprocessor is informed by the GDC that the buffer 23 can be reloaded. The feature of having such traffic control outside of the microprocessor adds to the overall speed of the operation.

Figure 2:
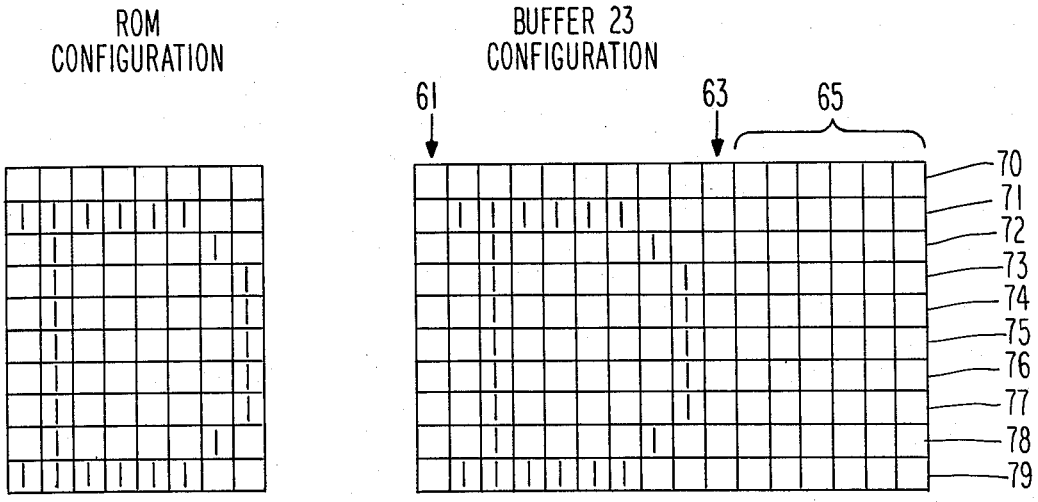
FIG. 2 depicts the letter "D" as it appears in the ROM and as it later appears in the buffer.
Figure 3:
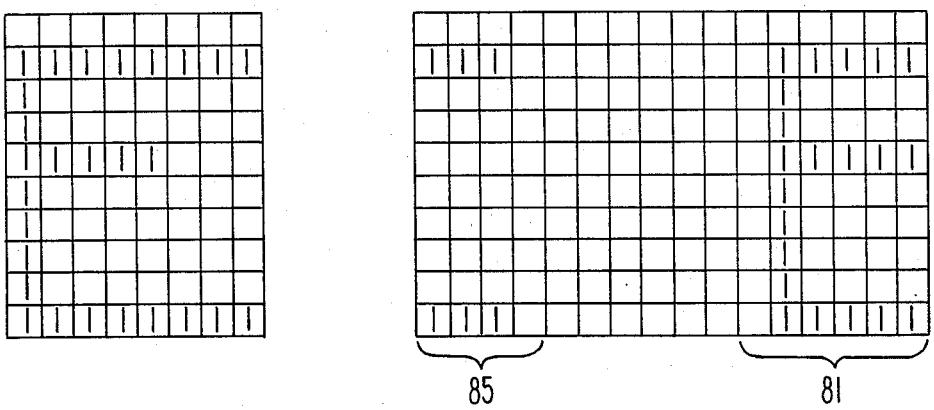
FIG. 3 depicts the letter "E" as it appears in the ROM and as it later appears in the buffer.
Figure 4:
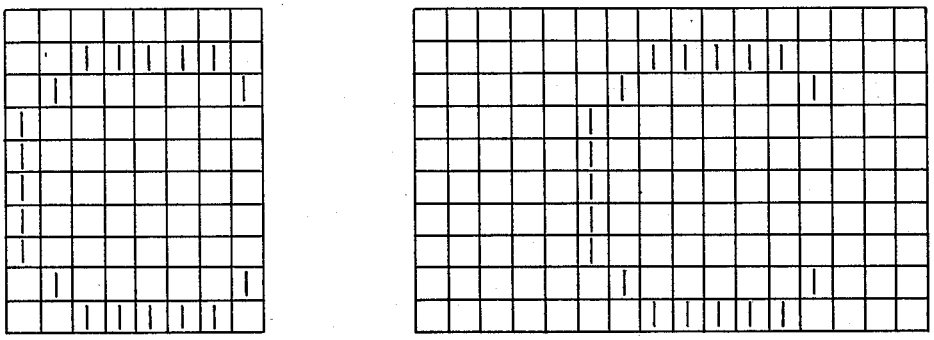
FIG. 4 depicts the letter "C" as it appears in the ROM and as it later appears in the buffer.

If we study FIGS. 2 through 5 the operation of the present system will become clearer. In FIGS. 2, 3 and 4, there is depicted on the left hand side the arrangement of the bit signals in the ROM. The letter "D" in FIG. 2 is shown in the ROM in an 8 by 10 configuration and it will be noted that the top row of the 8 by 10 matrix is left blank. The reason that the top row is left blank is so that when the letters are joined together on the screen, there will be margin between the rows of letters. In FIG. 3 the letter "E" is shown in the ROM on the left hand side in an 8 by 10 configuration, and in FIG. 4 the letter "C" is shown in the ROM in an 8 by 10 configuration.

When the letter "D" shown in the ROM configuration in FIG. 2 is transferred from the ROM 16 to the buffer 23 in FIG. 1, that set of bit signals is transmitted through the CPU of the microprocessor 15 and the signals are revolved so that they are located in the 16 by 10 buffer configuration shown in FIG. 2. It will be noted in the buffer configuration of FIG. 2 that there is a left hand column 61 which is shown blank. Actually there are zeros stored in the blank locations. It should also be noted that there is a right-hand column 63 which has zeros located in it. From the column 61 through the column 63 there are ten bit positions and hence the letter "D" in FIG. 2 in the buffer configuration is located in a 10 by 10 group. The remaining six columns 65 are blank and as will become better understood hereinafter, those columns are masked when the information is transferred from the buffer 23 into the bit map memory 33.

The microprocessor 15 is programmed to accommodate a number of formats. The microprocessor 15 knows that on the first transfer of a group of bit signals from the buffer 23, the letter will be configured in the first ten bits, and hence the control signals on channel 49 to the MUX 31 dictate that the mask effected on channel 40 will mask out the last six bit positions depicted as columns 65 in FIG. 2.

Figure 5:
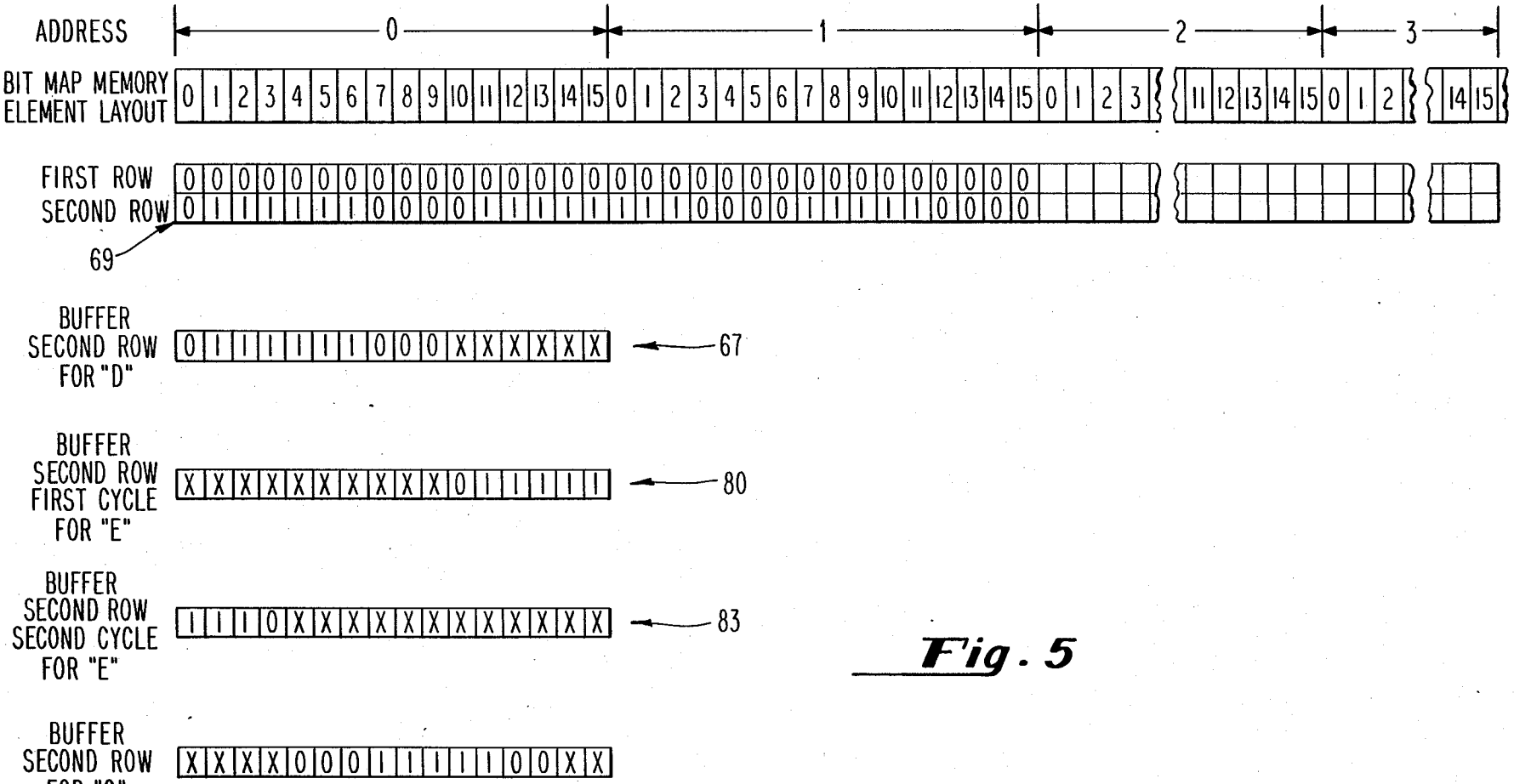
FIG. 5 depicts the transfer of bit signals from the buffer to the bit map memory.

The foregoing can be understood from a study of FIG. 5. In FIG. 5 there is shown the organization of four addresses in the bit map memory 33. At each of the addresses 0, 1, 2, and 3 (designated as address in FIG. 5) the bit map memory can store 16 bits or one word. The 16 bit locations are designated as 0 through 15. In FIG. 5 the first row (designated first row) represents the memory elements for the pixel locations on the CRT. It can be seen in FIG. 5 that all of these first row locations are blank. It will be recalled that the top row of the group in the ROM is blank to provide a margin between rows of words on the display, hence this first row is blank. The second row in FIG. 5 shows the bit signals which would be transferred to transfer the second row of each of the letters "D", "E" and "C" as depicted in FIGS. 2, 3 and 4. Thus far we have discussed the transfer of one row of bits in the letter "D" from the ROM to the buffer as depicted in FIG. 2 and let us consider how the bit signals are transferred from the buffer into the bit map memory as shown in FIG. 5. At location 67 the buffer is shown storing the second row of bit information (depicted in FIG. 2). When the second row of bit information is being transferred from the buffer 23, through the MUX 27, along channel 37, the microprocessor 15 provides the masking information to the MUX 31 so that the last six pixel locations are masked or blanked and this is indicated in FIG. 5 at location 67 by the small x's. Accordingly, loaded into the second row of the bit map memory at the positions 0 through 9, we see that the bit signals are the same as the bit signals in the first ten positions of the location 67. The starting address in the present address register in the GDC started out with the address 0, and the blank information shown in the first row was transmitted from the buffer into bit map memory. At that time the region length value register in the GDC 19 was decremented. In response to the next write clock signal the present address register in the GDC is incremented by 50, and hence the second row in the bit map memory and its positions 0 through 9 are loaded as shown starting at position 69. At that time the length register will be decremented and the operation continues until each of the rows 70 through 79 shown in FIG. 2 has been transferred from the buffer 23, through the MUX 27, along the channel 37 to the bit map memory. Since each of these transfers requires that the last six positions be masked, the mask information on 49 remains constant until there has been a transfer of a complete character from the buffer 23 to the bit map memory 33. When the GDC "present" register, has been incremented ten times and the length ending register has been decremented ten times, the GDC advises the microprocessor that a new character can be transferred from the ROM 16 through the RAM 18 to buffer 23. In the present embodiment seven words from the buffer 23 can be transferred to the bit map memory during a horizontal blank period. Accordingly at the end of such a horizontal blank period the GDC will have its present address register reading 400 or the eighth line and the length ending address register will be setting at 3. During the second horizontal blank period, the remaining three rows, namely rows 77 through 79 in FIG. 2, will be transferred from the buffer 23 to the bit map memory. During the third horizontal blank time, the microprocessor 15 will load the letter E from the ROM 16 through the RAM 18 into the buffer 23 and the process will repeat itself.

When the letter E is loaded from the ROM 16 to the buffer 23 it takes the configuration shown in FIG. 3. The microprocessor knows that the letter E is the second letter being loaded and the system knows that the bit positions 10, 11, 12, 13, 14 and 15 (FIG. 5) in the bit map memory must have a portion of the letter E loaded therein. Accordingly the letter E from the ROM, as shown in FIG. 3, is revolved so that it ends up in the buffer as shown in the buffer configuration portion of FIG. 3. During the first cycle of the second transfer the microprocessor sends masking instruction information on channel 49 so that the first ten column positions transferred from the buffer 23 are masked. This is shown at location 80 of FIG. 5. In location 80 of FIG. 5 it can be noted that the 0 through 9 bit positions would be masked (small x's) and only the information in the bit positions 10 through 15 would be transferred to the bit map memory. The system would repeat the operation, always masking the first ten positions until the bit map memory is loaded with the information shown in section 81 of FIG. 3. At this time the registers of the GDC would indicate to the microprocessor that section 81 had been loaded. However the microprocessor 15 is programmed to know that during the second operation there must be second unloading of the buffer 23 and at that time the positions 4 through 15 must be masked and shown by condition 83 in FIG. 5. In the condition 83, in FIG. 5, it can be seen that the first three bits plus the blank right hand column (shown in section 85 of FIG. 3) are being transferred to the bit map memory and that the positions 4 through 15 are masked out. The GDC in the meantime has changed the address from 0 to 1 and hence the three bits plus the blank column are located in positions 0, 1, 2 and 3 of address 1 in the bit map memory. When the registers in GDC 19 indicate to the microprocessor that the loading of section 85 has been completed, the microprocessor will commence to load the letter "C" from the ROM 16 through RAM 18 into the buffer 23 as shown in the buffer configuration of FIG. 4. When the third letter, in our case the letter "C", is transferred from the buffer 23 to the bit map memory, the columns 0, 1, 2 and 3 as well as the columns 14 and 15 will be masked out, and hence the letter C will be transferred and loaded into the columns 5 through 13 with the operation being the same as that described above.

As was mentioned earlier, the bit signals are located in the buffer within a word configuration in the same way that they will loaded into the bit map memory within a word configuration, and this of course saves time in the ultimate transferring of the information into the bit map memory. It also becomes apparent from the foregoing discussion that the use of the microprocessor 15 as a dedicated slave for the purpose of encoding a few signals into a large number of signals increases the speed with which the information is transferred from the main computer to the CRT. In addition, the description of FIGS. 2,3,4 and 5 in conjunction with the understanding of FIG. 1 makes it clear that the transfer of the information from the buffer 23 in parallel, during blank times in response to the write clock signals rapidly increases the transfer of the information from the main computer to the CRT 51. The use of the GDC to provide the starting addresses and to keep track of what addresses are in effect as well as when the character has been transferred, contributes to the speed of the overall operation.

We claim:

1. In a system which has a CRT display means for displaying text characters and a bit map memory means connected thereto to store pixel information for transfer to said CRT display means, an arrangement for accelerating data signals representing text characters from a main computer means to said bit map memory means comprising in combination: microprocessor means connected to said main computer to receive therefrom instruction signals, address signals and coded signals representing text characters, said microprocessor means providing groups of bit signals arranged in different positions, each group of bit signals defining a different text character to be displayed, in response to receiving different groups of said coded signals; buffer means connected to said microprocessor means to receive said groups of bit signals and store the same for further transmission in parallel; first circuitry means connecting said buffer means to said bit map memory means for transmitting said groups of bit signals in parallel from said buffer means to said bit map memory means; controller circuitry means connected to said microprocessor means to receive address signals and instruction signals therefrom; second circuitry means connecting said controller circuitry means to said bit map memory means to provide address signals and instruction signals thereto to direct said different groups of bit signals to particular locations in said bit map memory and alternatively to cause said bit map memory means to read out pixel information from certain locations to said CRT display means.

2. In a system which has a CRT display means, an arrangement for accelerating data signals according to claim 1 wherein said microprocessor means arranges said bit signals of each of said groups of bit signals when they are transmitted to said buffer means so that said bit signals are located in said buffer in certain positions relative to one another whereby when they are directed to said bit map memory they will be arranged in said certain positions relative to one another.

3. In a system which has a CRT display means, an arrangement for accelerating data signals according to claim 1 wherein said controller circuitry means includes a clock signal generator which generates write signals, horizontal sync signals and vertical sync signals and wherein said clock signal generator is connected to said buffer means to cause said buffer means to transmit segments of said groups of bit signals during horizontal and vertical blank times.

4. In a system which has a CRT display means, an arrangement for accelerating data signals according to claim 3 wherein said microprocessor means monitors said buffer means so that said buffer means must transmit all of the bit signals it is holding before said microprocessor means will transmit a new group of bit signals thereto.

5. In a system which has a CRT display means, an arrangement for accelerating data signals according to claim 1 wherein there is further included a masking means to mask signals being transmitted from said buffer means to said bit map memory means and wherein there is third circuitry means coupling said masking means to said microprocessor means to receive control signals from said microprocessor means.

6. In a system which has a CRT display means, an arrangement for accelerating data signals according to claim 1 wherein each character to be displayed is formed in ROM means in said microprocessor means in an $8\times10$ matrix of bit signals and is transformed into a $16\times10$ matrix of bit signals in said microprocessor means and wherein said buffer means receives and stores at least a $16\times10$ matrix of bit signals and wherein there is further included a masking means to mask signals being transmitted from said buffer means to said bit map memory means and wherein there is third circuitry means coupling said masking means to said microprocessor to receive control signals from said mirocprocessor means whereby said masking means operates on said bit signals in conjunction with address signals from said controller circuitry means to reduce every eight $16\times10$ matrix of bit signals into eight $10\times10$ matrix of bit signals when located in said bit map memory means.

7. In a system which has a CRT display means, an arrangement for accelerating data signals according to claim 1 wherein said microprocessor includes read only memory means which receives said groups of coded signals and provides a different matrix of bit signals respectively for each different group of coded signals received.

8. In a system which has a CRT display means for displaying text characters and a bit map memory means connected thereto to store pixel information for transfer to said CRT display means, an arrangement for accelerating data signals representing text characters from a main computer to said bit map memory means comprising in combination: microprocessor means having at least ROM means connected to said main computer to receive therefrom instruction signals, address signals and coded signals representing text characters, said ROM means providing respectively different matrices of bit signals, each of which matrices defines a text character in configuration, in response to receiving different groups of said coded signals; buffer means connected to said microprocessor means to receive said matrices of bit signals and store the same for further transmission in parallel; first circuitry means disposed to connect said buffer means to said bit map memory means for transmitting said raster of bit signals in parallel thereto; controller circuitry means connected to said microprocessor means to receive address signals and instruction signals thereform; second circuitry means connecting said controller circuitry means to said bit map memory to provide address signals thereto direct said matrices of bit signals to particular locations in said bit map memory means and alternatively to cause said bit map memory means to read said pixel information from certain locations to said CRT display means; said control circuitry means including clock signal generator means which generate write signals, horizontal sync signals and vertical sync signals, said clock signal generator means being connected at least to said buffer means to cause said buffer means to transmit segments of said matrices of bit signals during horizontal and vertical blank times; masking means to selectively mask signals being transmitted from said buffer means to said bit map memory means; and third circuitry means coupling said masking means to said microprocessor means to receive control signals therefrom whereby in response to a group of coded signals being transmitted by said main computer to said microprocessor means, said coded signals are encoded into a matrix of bit signals, arranged into suitable positions in said microprocessor means and transmitted to said buffer means and whereby thereafter in response to clock signals, during horizontal and vertical blank times, groups of bit signals from said buffer means are transmitted in parallel to said bit map memory means whereat they are partially passed and partially masked enroute to locations designated by address signals transmitted to said bit map memory from said controller circuitry.

* * * * *